US005402978A

United States Patent [19]

Larson

[11] Patent Number: 5,402,978

[45] Date of Patent: Apr. 4, 1995

[54] SPARE TOILET TISSUE HOLDER APPARATUS

[76] Inventor: Wesley H. Larson, 7587 E. Windrose Dr., Scottsdale, Ariz. 85260

[21] Appl. No.: 174,415

[22] Filed: Dec. 28, 1993

[51] Int. Cl.[6] ..... A47F 5/00

[52] U.S. Cl. ..... 248/309.2; D6/521

[58] Field of Search ..... 248/309.2, 231.2; 242/55.3, 55.42; D6/521

[56] References Cited

U.S. PATENT DOCUMENTS

| | | | |
|---|---|---|---|
| D. 147,623 | 10/1947 | Silvers | D6/521 |
| D. 155,897 | 11/1949 | Huntington | D6/521 |
| 1,966,247 | 7/1934 | Janssen | 248/309.2 X |
| 2,032,017 | 2/1936 | Hocher | 248/309.2 |
| 2,555,531 | 6/1951 | Boord | 242/55.3 |
| 2,931,997 | 4/1960 | Scribner | 248/309.2 X |
| 3,294,352 | 12/1966 | Leonard | 248/309.2 |
| 3,370,805 | 2/1968 | Bardee | 242/55.42 |
| 3,750,890 | 8/1973 | Smith | 248/309.2 X |
| 3,792,822 | 2/1974 | Underhill | 248/309.2 X |
| 5,022,625 | 6/1991 | Klinkhardt | 248/309.2 |

FOREIGN PATENT DOCUMENTS

| | | | |
|---|---|---|---|
| 124549 | 4/1949 | Sweden | 248/309.2 |
| 1341962 | 12/1973 | United Kingdom | 248/309.2 |

*Primary Examiner*—J. Franklin Foss

*Attorney, Agent, or Firm*—H. Gordon Shields

[57] ABSTRACT

Holder apparatus for a spare roll of toilet tissue includes a base element which may be secured in virtually any orientation and to virtually any type of surface, and a form extending outwardly from the base. The form includes elements for frictionally engaging the center core of a roll of toilet paper for holding the roll of toilet paper onto the holder apparatus. Several different embodiments are illustrated, including two general base element types and several different forms secured to the bases.

14 Claims, 1 Drawing Sheet

SPARE TOILET TISSUE HOLDER APPARATUS

BACKGROUND OF THE APPARATUS

1. Field of the Invention

This invention relates to a holder apparatus for a roll of toilet tissue and, more particularly to a holder of a spare roll of toilet tissue.

2. Description of the Prior Art

In a bathroom or restroom, adjacent to the toilet stool is a holder of a roll of toilet tissue. It is not uncommon for the roll of toilet tissue to be used up and then for a user to have to hunt for a new roll. In some bathrooms, a spare roll of toilet tissue may be disposed on the top of the tank. In some situations, the spare roll may be covered or may have some type of covering.

In commercial installations, there is sometimes a spare roll on top of the usable roll in a particularly configured housing. Such housing is seldom, if ever, used in a home environment. Typically, the only spare roll in a home environment is a roll disposed on the top of the toilet tank.

The apparatus of the present invention comprises a holder for a spare roll of toilet tissue, principally a spare roll, and the holder may be disposed in any convenient location, and in virtually in any particular orientation, as convenient.

There have been various types of holders of circular elements, similar to toilet tissue rolls, and there have also been different types of holders for rolls of toilet tissue. However, none of them have enjoyed commercial success as a practical element for holding a spare roll of toilet tissue.

U.S. Pat. No. 3,041,101 (Feifert) discloses a form holding a coil of wire. The form is collapsible.

U.S. Pat. No. 3,413,049 (Smay) discloses a holder of toilet tissue. The holder holds multiple rolls. The holder includes a vertical central member which extends downwardly from the lid. The apparatus holds two rolls of toilet paper, with the lower most roll being accessible for use, and the upper most being a spare roll.

U.S. Pat. No. 3,475,067 (Girard) discloses a toilet tissue dispenser which hooks onto the side of a toilet bowl. The dispenser comprises a canister which holds two rolls of toilet paper, with the upper roll being available for use. The bottom roll is a spare roll. The apparatus includes two mandrils which extend horizontally and hold the two rolls.

U.S. Pat. No. 4,012,007 discloses a paper towel dispenser adapted to be disposed on the top of a sink. The roll of paper towels is held vertically and a suction cup secures the holder to the sink.

U.S. Pat. No. 4,074,872 (Marshall) discloses a spare toilet paper holder which is clipped to the side of a toilet tank. The apparatus includes a hook to fit over the rim of the toilet tank. The apparatus includes a horizontally extending platform and a vertical pin extending upwardly from the platform. The spare roll is disposed on the platform and over the pin.

U.S. Pat. No. 4,179,078 (Mansfield) discloses a toilet paper dispenser which is fastened to a wall. The dispenser includes a cover which pivots downwardly to cover a roll of toilet paper. The toilet paper roll is held on a pin which extends outwardly from a vertically extending plate.

U.S. Pat. No. 4,248,391 (Ness) includes a lazy susan type dispenser for a roll of toilet paper in which the roll is disposed on a vertical frusto conical projection which is rotatable on a fixed base.

U.S. Pat. No. 4,273,299 (Ness) is similar to the '391 patent in general configuration. There is a fixed base member and upper member movable on the base member for holding a roll or toilet paper.

U.S. Pat. 4,898,335 (Eysink) discloses a support stand for a plurality of rolls of toilet paper. The apparatus includes a base which may be disposed on the floor or on any other generally horizontal surface. Multiple rolls of toilet paper are disposed on a post extending upwardly from the base. The top of the post includes a knob which is removed to add rolls of toilet paper and to remove empty roll cores.

U.S. Pat. No. 5,170,958 (Brown) discloses protective cover for a toilet paper roll. The cover uses hook and loop type fasteners to secure the cover to a wall. The cover fits over a roll of toilet paper and the holder of the roll on a wall. The toilet paper or tissue is dispensed through a slot on the bottom of the cover.

SUMMARY OF THE INVENTION

The invention described and claimed herein comprises a base element which may be secured in virtually any desired orientation. A form extends outwardly from the base for holding a roll of toilet paper. The form includes elements which frictionally engage the inside of the core of the roll of toilet tissue for securing the toilet tissue to the apparatus in any particular orientation, vertical, horizontal, or virtually any angle in between. Several embodiments are illustrated.

Among the objects of the present invention are the following:

- To provide new and useful holder apparatus for holding a single roll of toilet tissue;
- To provide new and useful holder apparatus having a base securable to a variety of surfaces and a form extending outwardly from the base for engaging the inside of the core of a roll of toilet tissue;
- To provide new and useful holder apparatus for a spare roll of toilet tissue; and
- To provide new and useful apparatus for holding a spare roll of toilet tissue in a variety of orientations by use of a form which frictionally engages the inside of the core element of a roll of toilet tissue.

DESCRIPTION OF THE PREFERRED EMBODIMENT

Figure 1:
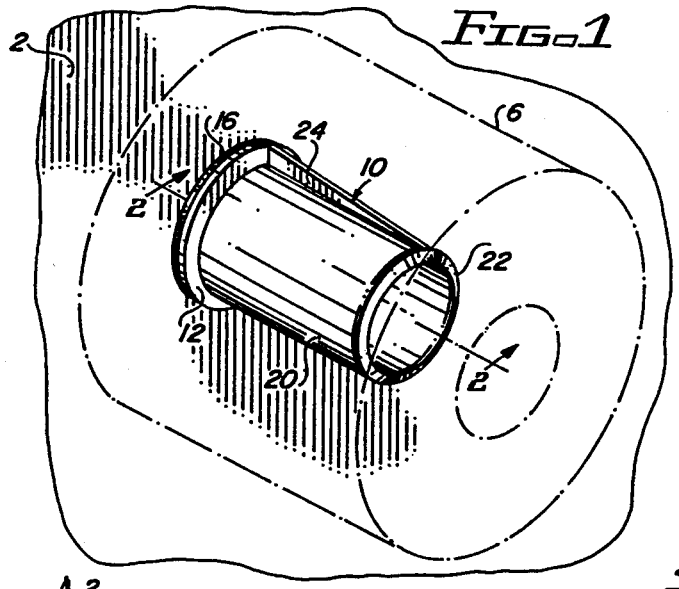
FIG. 1 is a perspective view of the apparatus of the present invention in the use environment.
Figure 3:
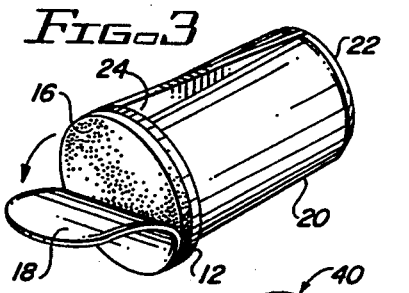
FIG. 3 is a rear perspective view of the apparatus of the present invention.
Figure 2:
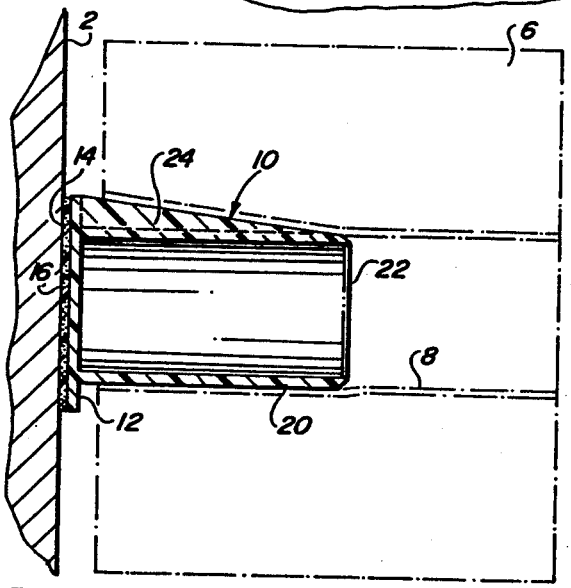
FIG. 2 is a sectional view taken generally along line 2—2 of FIG. 1.

FIG. 1 is a perspective view of holder apparatus 10 of the present invention in its use environment, namely secured to a vertical wall 2 and extending outwardly therefrom with a roll of toilet tissue 6 secured to the holder apparatus 10. The roll 6 includes a core 8 (see FIGS. 2 and 5), and the roll is held by a frictional engagement with the core 8. FIG. 2 is a view in partial section taken generally along line 2—2 of FIG. 1. FIG. 3 is a rear perspective view of the holder apparatus 10. For the following discussion of the holder apparatus 10, reference will be made to FIGS. 1, 2, and 3.

The holder apparatus 10 includes a base 12 and a cylinder 20 extending outwardly from the base 12. A base 12 includes a bottom end 14 to which is secured an adhesive layer 16. Prior to installation of the holder apparatus 10, a protective cover is disposed over the adhesive layer 16.

The cylinder 20 extends outwardly from the base 12 generally perpendicular thereto. The cylinder 20 includes an outer end 22 remote from the base 12. A tapered ridge 24 extends between the base 12 and the outer end 22. The purpose of the tapered ridge 24 is to provide a frictional engagement with the inside of the core 8 of the roll 6 to hold the roll in position on the holder apparatus 10.

Figure 5:
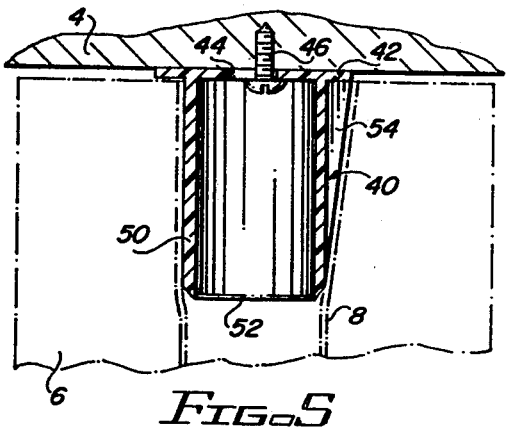
FIG. 5 is a view in partial section taken generally along line 5—5 of FIG. 4 an illustrating the apparatus of FIG. 4 in a use environment.

The holder apparatus 10 may be installed in virtually any location and in virtually any orientation using only the adhesive layer 16 to secure the holder apparatus 10 to an appropriate surface, such as the wall 2. While the wall 2 is shown as a vertical wall, the holder apparatus 10 may also be installed in a vertical orientation, such as to the bottom of a cabinet, or toilet bowl, or the like. In FIG. 5, a horizontal surface, such as of a cabinet 4 is illustrated. The holder apparatus 10 may also be installed in such a location, in which it extends vertically downwardly. The ridge 24 provides a necessary friction with the core 8 to hold the roll 6 in place.

Figure 4:
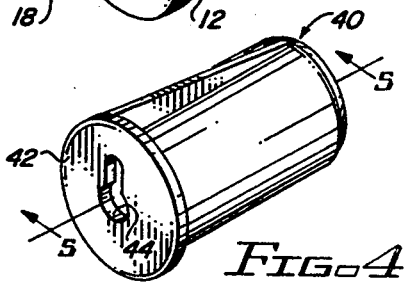
FIG. 4 is a rear perspective view of an alternate embodiment off, the apparatus of the present invention

FIG. 5 comprises a view in partial section taken generally along line 5—5 of FIG. 4, and showing the alternate embodiment 40 in its use environment.

An alternate embodiment of the holder apparatus 10 is illustrated in FIGS. 4 and 5. The alternate embodiment shown in FIGS. 4 and 5 comprises holder apparatus 40. The holder apparatus 40 includes a base 42 with a cylinder 50 extending outwardly from the base 42. The cylinder 50 includes an outer end 52 and a tapered rib 54 which extends from the base 42 to the end 52. In the elements discussed so far, the holder apparatus 40 is substantially identical to the holder apparatus 10. However, the holder apparatus 40 does not include an adhesive layer to secure the base 42 to a surface. Rather, the base 42 includes a keyhole aperture 44 for receiving a screw 46.

The keyhole aperture 44 includes two portions, a large portion which receives the head of the screw 46 and a smaller portion which has a diameter less than the diameter of the head of the screw 46, and which allows the user to remove the unit without disengaging the screw. The screw 46 preferably extends into a wooden element, such as a cabinet 4. If desired, of course, various appropriate elements may be used to secure the screw 46, and also the holder apparatus 40, to a wallboard surface, or the like., instead of screwing into wood. Such is, of course, well known and understood in the art.

In FIG. 5, the holder apparatus 40 is shown extending vertically downwardly, with the roll 6 of toilet tissue secured to the holder 40. Again, the rib 54 provides sufficient friction to hold the spare roll 6 in virtually any orientation, whether vertical, as shown in FIG. 5, or horizontal, such as illustrated in FIG. 2 with respect to the holder apparatus 10.

Figure 6:
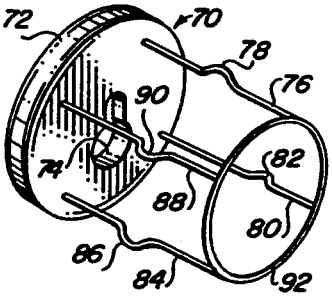
FIG. 6 is a front perspective view of an alternate embodiment of the apparatus of the present invention.

FIG. 6 is a perspective view of another alternate embodiment of the spare roll holder apparatus of the present invention, comprising an alternate embodiment 70 which includes wire or plastic arms secured to a base 72. A keyhole aperture 74 extends through the base 72. The keyhole aperture 74 is substantially identical to the keyhole aperture 44 of the apparatus 40.

Extending outwardly from the base 40 are four arms, including arms 76, 80, 84, and 88. The arms 76, 80, 84, and 88 each include an outwardly extending curved portion which, essentially comprise frictional engagement bump elements. The arm 76 includes an outwardly or convexly extending element 78, the arm 80 includes an element 82, the arm 84 includes an element 86, and the arm 88 includes an element 90. The four outwardly extending or convexly configured elements 78, 82, 86, and 90 provide sufficient frictional engagement with the core form 8 to hold a roll 6 in virtually any orientation, either horizontal, as illustrated in FIG. 2, or vertical, as illustrated in FIG. 5.

At the outer ends of the arms 76, 80, 84, and 88 is a loop 92. The loop 92 is a circular element appropriately secured to the outer or distal ends of the four arms 76, 80, 84, and 88. The loop 92 provides a termination form for the four arms remote from the base 72.

Figure 7:
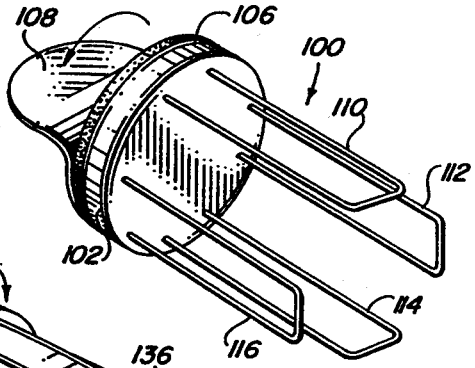
FIG. 7 is a front perspective view of another alternate embodiment of the apparatus of the present invention.

FIG. 7 comprises a perspective view of another alternate embodiment, namely holder apparatus 100. The apparatus 100 includes a base 102 to which is secured an adhesive layer 106. A protective cover 108 is disposed over the adhesive layer 106. The adhesive layer 106, with its cover 108, are substantially identical to the adhesive layer 16 and its cover 18 of the apparatus 10, discussed above, and illustrated in FIGS. 1, 2, and 3.

The apparatus 100 also includes four sets of generally "U" shaped elements which extend outwardly from the base 102 remote from the adhesive layer 106. The "U" shaped elements include an element 110, an element 112, an element 114, and an element 116. The elements 110, 112, 114, and 116 preferably diverge or extend slightly outwardly to provide a frictional engagement with a core 8 of a spare roll 6.

Again, the holder apparatus 100 may be oriented in virtually any position, from the horizontal illustrated in FIG. 2 to the vertical illustrated in FIG. 5.

Figure 8:
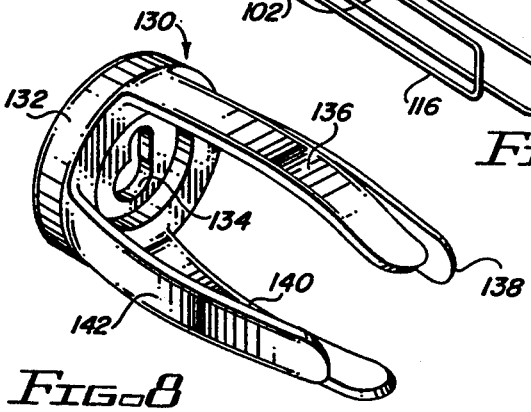
FIG. 8 is a front perspective view of another alternate embodiment of the apparatus of the present invention.

FIG. 8 comprises a perspective view of another alternate embodiment of the holder apparatus of the present invention, namely holder apparatus 130. The holder apparatus 130 includes a base 132 through which extends a keyhole aperture 134. The keyhole aperture 134 is substantially identical to the keyhole aperture 74 of the embodiment 70 of FIG. 6 and the keyhole aperture 44 of the holder apparatus 40 illustrated in FIGS. 4 and 5. That is, the hint of a screw extends through the relatively large portion of the keyhole aperture 134 and the apparatus 130 is then moved relative to the fixed screw until the shank is disposed in the relatively narrow portion of the keyhole aperture 134. The screw is then tightened until the head of the screw is disposed against the inside or bottom portion of the base 132 to hold the apparatus 30 securely in place.

The holder apparatus 130 includes four spring arms which extend outwardly from the base. The spring arms includes arms 136, 138, 140 and 142. The arms are slightly bowed outwardly and then inwardly. The outward or convex curvature or configuration of the arms provides the frictional engagement against the core form 8 of the roll 6.

Again, the holder apparatus 130 may be oriented as desired, with the frictional engagement between the core 8 of a roll 6 with the spring arms 136, 138, 140, and 142 sufficient to hold the roll 6 in virtually any orientation, from horizontal, as shown in FIG. 2, to vertical, as shown in FIG. 5.

While the configuration of the holes or apertures 44, 74, and 134 has been defined as a keyhole configuration, such is not necessary, only perhaps desirable and advantageous. However, a circular hole cover also may be used.

As illustrated in FIGS. 2 and 5, the overall length of the various holder apparatus embodiments need not be the full length of the toilet tissue roll 6. The only requirement, with respect to the length of the apparatus, is that the length of the holder apparatus be sufficient to provide the frictional engagement to hold the toilet tissue in any desired orientation from the horizontal, as shown in FIGS. 1 and 2 to the vertical, as shown in FIG. 5.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Holder apparatus for holding a spare roll of toilet tissue to a surface in any desired orientation comprising in combination:

a base;

a cylindrical form secured to the base and extending outwardly therefrom for supporting a roll of toilet tissue;

friction means on the cylindrical form for frictionally engaging the roll of toilet tissue to hold the roll of toilet tissue to the form in any desired orientation comprising a tapered ridge extending along the form; and means for securing the base to a surface.

2. The apparatus of claim 1 in which the means for securing the base to a surface comprises an adhesive.

3. The apparatus of claim 1 in which the means for securing the base to a surface includes a hole in the base and a fastener element extending through the hole to fasten the base to a surface.

4. Holder apparatus for holding a spare roll of toilet tissue to a surface in any desired orientation comprising in combination:

a base to be secured to a surface;

a plurality of arms secured to the base and extending outwardly therefrom for supporting a roll of toilet tissue;

a loop secured to the plurality of arms remote from the base;

friction means on the plurality of arms for frictionally engaging the roll of toilet tissue to hold the roll of toilet tissue to the arms in any desired orientation; and means for securing the base to the surface.

5. The apparatus of claim 4 in which the form means comprises wire elements.

6. The apparatus of claim 5 in which the friction means includes bumps on the wire elements.

7. The apparatus of claim 4 in which the form means comprises plastic elements.

8. The apparatus of claim 7 in which the friction means includes bumps on the arms.

9. The apparatus of claim 4 in which the means for securing the base to the surface comprises an adhesive.

10. The apparatus of claim 4 in which the means for securing the base to the surface includes a hole in the base and a fastener element extending through the hole to fasten the base to the surface.

11. Holder apparatus for holding a spare roll of toilet tissue to a surface comprising in combination:

a base to be secured to a surface;

a plurality of spring arms extending outwardly from the base and spaced apart from each other for receiving the roll of toilet tissue; and means for securing the base to the surface.

12. The apparatus of claim 11 in which the friction means comprises convex curves in the spring arms.

13. The apparatus of claim 11 in which the means for securing the base to the surface comprises an adhesive.

14. The apparatus of claim 11 in which the means for securing the base to the surface includes a hole in the base and a fastener element extending through the base.

* * * * *